US010900371B2

(12) United States Patent
Shi et al.

(10) Patent No.: US 10,900,371 B2
(45) Date of Patent: Jan. 26, 2021

(54) ABRADABLE COATINGS FOR HIGH-PERFORMANCE SYSTEMS

(71) Applicants: Rolls-Royce Corporation, Indianapolis, IN (US); Rolls-Royce North American Technologies, Inc., Indianapolis, IN (US)

(72) Inventors: Jun Shi, Carmel, IN (US); Li Li, Carmel, IN (US); Ted J. Freeman, Danville, IN (US)

(73) Assignees: Rolls-Royce North American Technologies, Inc., Indianapolis, IN (US); Rolls-Royce Cornoration, Indianapolis, IN (US)

( * ) Notice: Subject to any disclaimer, the term of this patent is extended or adjusted under 35 U.S.C. 154(b) by 171 days.

(21) Appl. No.: 16/043,708

(22) Filed: Jul. 24, 2018

(65) Prior Publication Data

US 2019/0032503 A1 Jan. 31, 2019

Related U.S. Application Data

(60) Provisional application No. 62/537,642, filed on Jul. 27, 2017.

(51) Int. Cl.

| | |
|---|---|
| ***F01D 11/12*** | (2006.01) |
| ***F01D 25/24*** | (2006.01) |
| ***F01D 25/00*** | (2006.01) |

(52) U.S. Cl.

CPC ..... *F01D 11/122* (2013.01); *F01D 25/005* (2013.01); *F01D 25/24* (2013.01);
(Continued)

(58) Field of Classification Search

CPC ..... F01D 11/08; F01D 11/122; F01D 25/005; F01D 25/24

See application file for complete search history.

(56) References Cited

U.S. PATENT DOCUMENTS

| | | | |
|---|---|---|---|
| 2,803,943 | A | 8/1957 | Rainbow |
| 3,519,282 | A | 7/1970 | Davis |

(Continued)

FOREIGN PATENT DOCUMENTS

| | | | |
|---|---|---|---|
| EP | 0798454 | A2 | 10/1997 |
| EP | 1911938 | A1 | 4/2008 |

(Continued)

OTHER PUBLICATIONS

U.S. Appl. No. 62/537,653, by Jun Shi et al., filed Jul. 27, 2017.
U.S. Appl. No. 15/986,570, filed May 22, 2018, by Walston et al.

*Primary Examiner* — Brian P Wolcott
(74) *Attorney, Agent, or Firm* — Shumaker & Sieffert, P.A.

(57) ABSTRACT

An example high-performance system may include an example high-performance component. The high-performance component may include a substrate defining a channel. The channel defines a leading ramp and a trailing ramp. The example high-performance component includes an abradable track between the leading and the trailing ramps. The abradable track includes a porous abradable composition. The example high-performance system may include a rotating component configured to contact and abrade the abradable track. An example technique for forming the abradable track includes thermal spraying a precursor composition at the channel to form the abradable track.

18 Claims, 2 Drawing Sheets

(52) U.S. Cl.
CPC .... *F05D 2220/323* (2013.01); *F05D 2230/31* (2013.01); *F05D 2230/312* (2013.01); *F05D 2230/313* (2013.01); *F05D 2230/314* (2013.01); *F05D 2230/40* (2013.01); *F05D 2230/90* (2013.01); *F05D 2240/11* (2013.01); *F05D 2240/55* (2013.01); *F05D 2250/131* (2013.01); *F05D 2260/00* (2013.01); *F05D 2300/2112* (2013.01); *F05D 2300/2118* (2013.01); *F05D 2300/222* (2013.01); *F05D 2300/224* (2013.01); *F05D 2300/2261* (2013.01); *F05D 2300/2281* (2013.01); *F05D 2300/2282* (2013.01); *F05D 2300/2283* (2013.01); *F05D 2300/514* (2013.01); *F05D 2300/6012* (2013.01); *F05D 2300/6033* (2013.01)

(56) References Cited

U.S. PATENT DOCUMENTS 3,543,588 A 12/1970 Richardson
3,688,560 A 9/1972 Broman et al.
3,719,365 A 3/1973 Emmerson et al.
4,044,973 A 8/1977 Moorehead
4,118,997 A 10/1978 Woodward et al.
4,218,066 A 8/1980 Ackermann
4,269,903 A 5/1981 Clingman et al.
4,337,016 A 6/1982 Chaplin
4,422,648 A 12/1983 Eaton et al.
4,430,360 A 2/1984 Bill et al.
4,497,171 A 2/1985 Corrigan et al.
4,503,130 A 3/1985 Bosshart et al.
4,639,388 A 1/1987 Ainsworth et al.
4,744,725 A 5/1988 Matarese et al.
4,884,820 A 12/1989 Jackson et al.
4,912,921 A 4/1990 Rice et al.
5,167,721 A 12/1992 McComas et al.
5,349,814 A 9/1994 Ciokajlo et al.
5,375,973 A 12/1994 Sloop et al.
5,435,124 A 7/1995 Sadil et al.
5,439,348 A * 8/1995 Hughes ..... F01D 11/122 29/889.2
5,662,757 A 9/1997 Langenbrunner et al.
5,683,789 A 11/1997 Langenbrunner et al.
5,694,765 A 12/1997 Hield et al.
5,867,979 A 2/1999 Newton et al.
5,867,980 A 2/1999 Bartos
6,170,252 B1 1/2001 Van Duyn
6,203,021 B1 * 3/2001 Wolfla ..... C23C 4/18 277/415
6,260,351 B1 7/2001 Delano et al.
6,357,220 B1 3/2002 Snyder et al.
6,358,002 B1 * 3/2002 Good ..... F01D 11/122 415/174.4
6,365,236 B1 4/2002 Maloney
6,447,248 B1 9/2002 Kastl et al.
6,457,939 B2 10/2002 Grasripoor et al.
6,467,725 B1 10/2002 Coles et al.
6,652,227 B2 11/2003 Fried
6,670,046 B1 12/2003 Xia
6,851,267 B2 2/2005 Bruno et al.
6,887,528 B2 5/2005 Lau et al.
6,887,529 B2 5/2005 Borneman et al.
6,914,344 B2 7/2005 Franchet et al.
6,916,529 B2 7/2005 Pabla et al.
7,013,651 B2 3/2006 Bruno et al.
7,029,232 B2 4/2006 Tuffs et al.
7,055,330 B2 6/2006 Miller
7,059,136 B2 6/2006 Coffinberry
7,223,067 B2 5/2007 Wilson et al.
7,360,991 B2 4/2008 Ford et al.
7,425,115 B2 9/2008 Johnson et al.
7,479,328 B2 1/2009 Roth-Fagaraseanu et al.
7,618,712 B2 11/2009 Sabol et al.
7,753,643 B2 7/2010 Gonzalez et al.
7,819,625 B2 10/2010 Merrill et al.
7,846,561 B2 12/2010 Kulkarni
7,935,413 B2 5/2011 Stamm
8,007,899 B2 8/2011 Freling et al.
8,042,341 B2 10/2011 Charier et al.
8,061,978 B2 11/2011 Tholen et al.
8,100,640 B2 1/2012 Strock et al.
8,124,252 B2 2/2012 Cybulsky et al.
8,162,602 B2 4/2012 Caucheteux et al.
8,172,519 B2 5/2012 Jarrabet et al.
8,309,197 B2 11/2012 Davis et al.
8,650,753 B2 2/2014 Sellars et al.
8,658,255 B2 2/2014 Kirby et al.
8,939,707 B1 1/2015 Lee et al.
8,966,911 B2 3/2015 Ress, Jr. et al.
9,458,726 B2 10/2016 Lamusga et al.
9,598,973 B2 3/2017 Ghasripoor et al.
9,644,489 B1 5/2017 Tham et al.
9,713,912 B2 7/2017 Lee
9,759,082 B2 * 9/2017 Thomas ..... F01D 11/18
9,995,165 B2 6/2018 Joe et al.
10,196,918 B2 * 2/2019 McCaffrey ..... F01D 11/08
10,247,027 B2 * 4/2019 Rioux ..... F04D 29/164
10,267,174 B2 * 4/2019 Liu ..... C23C 4/126
10,494,945 B2 * 12/2019 Grande ..... C23C 4/126
2003/0054196 A1 3/2003 Lau et al.
2003/0138658 A1 7/2003 Taylor et al.
2004/0021256 A1 2/2004 DeGrange et al.
2005/0132693 A1 6/2005 MacFarlane et al.
2005/0220612 A1 10/2005 Jahns et al.
2006/0010875 A1 1/2006 Mahoney et al.
2006/0101804 A1 5/2006 Stretton
2006/0225431 A1 10/2006 Kupratis
2006/0248900 A1 11/2006 Suciu et al.
2006/0260323 A1 11/2006 Moulebhar
2006/0272313 A1 12/2006 Eick et al.
2007/0022735 A1 2/2007 Henry et al.
2007/0084216 A1 4/2007 Mazeaud et al.
2007/0137219 A1 6/2007 Linet et al.
2007/0151258 A1 7/2007 Gaines et al.
2007/0205189 A1 9/2007 Grossklaus et al.
2007/0289310 A1 12/2007 Dooley et al.
2008/0148881 A1 6/2008 Moniz et al.
2008/0279678 A1 11/2008 Merrill et al.
2009/0007569 A1 1/2009 Lemmers, Jr. et al.
2009/0110536 A1 4/2009 Strock et al.
2009/0290976 A1 11/2009 Suciu et al.
2009/0324930 A1 12/2009 Tulyani et al.
2010/0030365 A1 2/2010 Lilly
2010/0104426 A1 4/2010 Keller et al.
2010/0129636 A1 5/2010 Cybulsky et al.
2010/0136349 A1 6/2010 Lee
2010/0151183 A1 6/2010 Davis et al.
2010/0159151 A1 6/2010 Kirby et al.
2010/0171241 A1 7/2010 Huskamp et al.
2011/0033630 A1 2/2011 Naik et al.
2011/0219775 A1 * 9/2011 Jarmon ..... C04B 35/573 60/753
2012/0213659 A1 8/2012 Bayer et al.
2013/0045091 A1 2/2013 Della-Fera et al.
2013/0078085 A1 3/2013 Strock et al.
2013/0236293 A1 9/2013 Adaickalasamy
2014/0199163 A1 7/2014 Lee
2014/0367921 A1 12/2014 Konigs et al.
2015/0048553 A1 2/2015 Dietrich et al.
2015/0239010 A1 8/2015 Cheung
2015/0354395 A1 12/2015 Scothern
2016/0047264 A1 2/2016 Joe et al.
2016/0130969 A1 5/2016 Gold
2016/0146034 A1 5/2016 Schuster
2016/0305319 A1 10/2016 Baldiga et al.
2016/0369636 A1 12/2016 Hitchman et al.
2017/0089213 A1 3/2017 Stevens et al.
2017/0268367 A1 9/2017 McCaffrey
2017/0276007 A1 9/2017 Rioux et al.
2017/0306783 A1 10/2017 Grande et al.
2017/0314410 A1 11/2017 Liu et al.
2018/0023396 A1 1/2018 Narrow et al.

(56) References Cited

U.S. PATENT DOCUMENTS

| | | | | |
|---|---|---|---|---|
| 2018/0202460 | A1 | 7/2018 | Kray | |
| 2018/0290334 | A1* | 10/2018 | Corsmeier | F02C 7/36 |
| 2018/0290391 | A1* | 10/2018 | Corsmeier | B29C 70/345 |
| 2019/0360351 | A1* | 11/2019 | Walston | F01D 11/122 |

FOREIGN PATENT DOCUMENTS

| | | | |
|---|---|---|---|
| EP | 2085589 | A2 | 8/2009 |
| EP | 2319641 | A1 | 5/2011 |
| EP | 3239475 | A1 | 11/2017 |
| GB | 1127659 | | 9/1968 |
| WO | 1995/002120 | A1 | 1/1995 |
| WO | 02/18674 | A2 | 3/2002 |
| WO | 2015173312 | A1 | 11/2015 |

* cited by examiner

ABRADABLE COATINGS FOR HIGH-PERFORMANCE SYSTEMS

This application claims the benefit of U.S. Provisional Application No. 62/537,642, filed Jul. 27, 2017, which is incorporated by reference herein in its entirety.

TECHNICAL FIELD

The present disclosure generally relates to abradable coatings, for example, abradable coatings for high-performance systems including rotating components.

BACKGROUND

The components of high-performance systems, such as, for example, turbine or compressor components, operate in severe environments. For example, turbine blades, vanes, blade tracks, and blade shrouds exposed to hot gases in commercial aeronautical engines may experience metal surface temperatures of about 1000° C.

High-performance systems may include rotating components, such as blades, rotating adjacent a surrounding structure, for example, a shroud. Reducing the clearance between rotating components and a shroud may improve the power and the efficiency of the high-performance component. The clearance between the rotating component and the shroud may be reduced by coating the blade shroud with an abradable coating. Turbine engines may thus include abradable coatings at a sealing surface or shroud adjacent rotating parts, for example, blade tips. A rotating part, for example, a turbine blade, can abrade a portion of a fixed abradable coating applied on an adjacent stationary part as the turbine blade rotates. Over many rotations, this may cause a groove in the abradable coating corresponding to the path of the turbine blade. The abradable coating may thus form an abradable seal that can reduce the clearance between rotating components and an inner wall of an opposed shroud, which can reduce leakage around a tip of the rotating part or guide leakage flow of a working fluid, such as steam or air, across the rotating component, and enhance power and efficiency of the high-performance component.

SUMMARY

In some examples, the disclosure describes an example high-performance component including a substrate defining a channel. The channel defines a leading ramp and a trailing ramp. The example high-performance component includes an abradable track between the respective leading and the trailing ramps. The abradable track includes a porous abradable composition.

In some examples, the disclosure describes an example high-performance system including a high-performance component including a substrate defining a channel. The channel defines a leading ramp and a trailing ramp. The example high-performance component includes an abradable track between the respective leading and the trailing ramps. The abradable track includes a porous abradable composition. The high-performance system further includes a rotating component configured to contact an abradable surface of the abradable track with a portion of the rotating component.

In some examples, the disclosure describes an example technique for forming an abradable track on a high-performance component. The example technique includes thermal spraying a precursor composition at a channel defined by a substrate of the high-performance component to form the abradable track occupying the channel. The channel defines a leading ramp and a trailing ramp. The abradable track includes a porous abradable composition.

The details of one or more examples are set forth in the accompanying drawings and the description below. Other features, objects, and advantages will be apparent from the description and drawings, and from the claims.

DETAILED DESCRIPTION

The disclosure describes example high-performance components including a substrate defining a channel. The channel defines a leading ramp and a trailing ramp. An abradable track occupies the channel between the respective leading and the trailing ramps. The abradable track includes a porous abradable composition. Providing the abradable track between the leading and trailing ramps of the channel may help in improving or maintaining within predetermined tolerances the integrity of the abradable track, for example, by increasing resistance to chipping, disintegration, shattering, cracking, foreign object damage, or wear or erosion. Providing the leading and trailing ramps may also facilitate the operation or control of techniques for forming the abradable track (for example, thermal spraying) within predetermined design and performance tolerances.

An abradable coating may be applied on a surface defined by a high-performance component (for example, a compressor or a turbine section) to form a seal having a relatively close clearance with a rotating component adjacent the high-performance component. Under predetermined operating conditions, the rotating component may move radially toward a flow surface defined by the groove, reducing flow leakage and increasing efficiency of the high temperature component. Portions of rotating components (for example, tips of compressor and turbine blades), can contact and cut into the coating by abrading a surface of the coating, and creating a groove or a path.

Figure 1A:
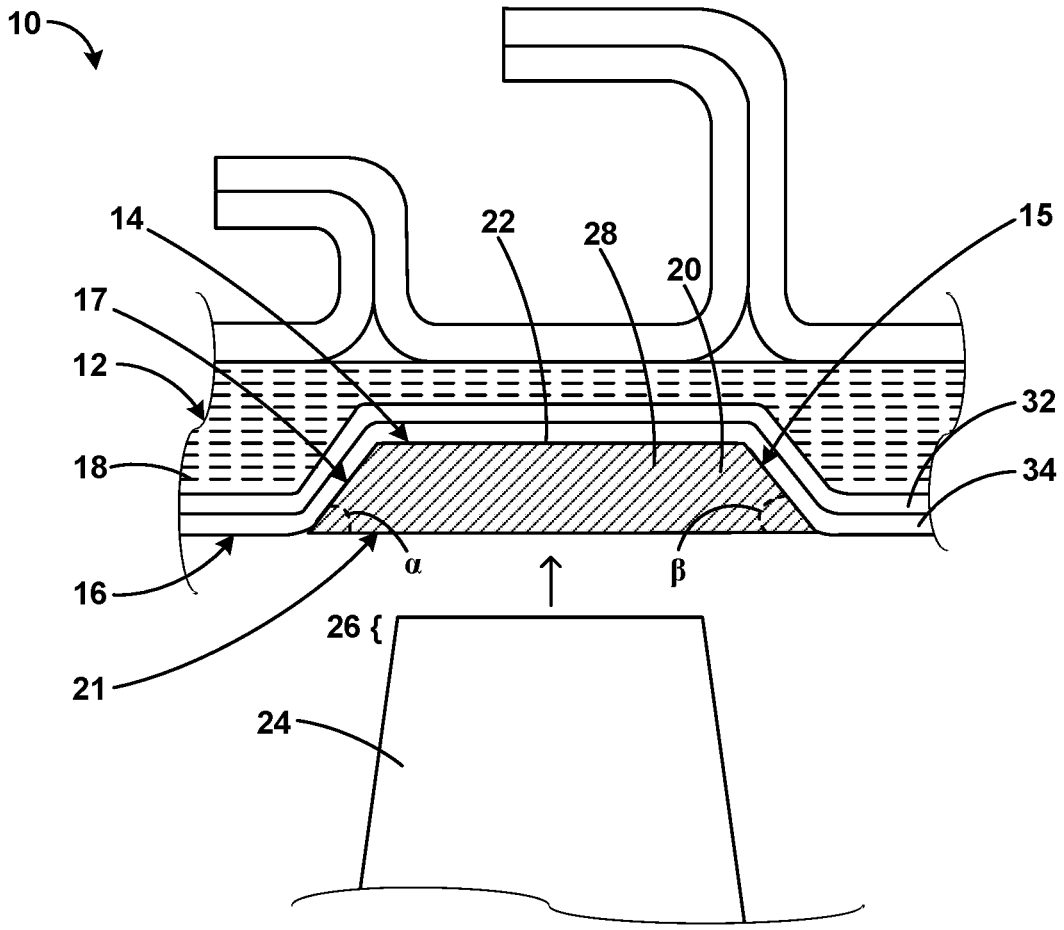
FIG. 1A is a conceptual and schematic cross-sectional diagram illustrating an example high-performance system including a high-performance component including a substrate defining a channel and including an abradable track.

FIG. 1A is a conceptual and schematic cross-sectional diagram illustrating an example high performance system including a high-performance component 10 including a substrate 12 defining a channel 14 and including an abradable track 20. High-performance component 10 or substrate 12 may define a major surface 16 adjacent channel 14. Abradable track 20 may define an abradable surface 21, for example, adjacent to major surface 16, and opposed to a base 22 of abradable track 20. High-performance component 10 may include a mechanical component operating at relatively high conditions of temperature, pressure, or stress, for example, a component of a turbine, a compressor, or a pump. In some examples, high-performance component 10 includes a gas turbine engine component, for example, an aeronautical, marine, or land-based gas turbine engine.

The example high-performance system of FIG. 1A may include a rotating component 24 adjacent to abradable track 20. For example, an end portion 26 or tip of rotating component 24 may be adjacent to abradable track 20, as shown in FIG. 1A. Rotating component 24 may include any component rotating adjacent to or along substrate 12. In some examples, rotating component 24 includes a blade or a lobe. For example, rotating component 24 may include a compressor or turbine blade. In other examples, rotating component 32 may include a pump or compressor lobe. Thus, in some examples, end portion 26 may include a tip of a blade or an end of a lobe. At least one of abradable surface 21 of abradable track 20 and surface 16 of high-performance component 10 may define a flow boundary between rotating component 24 and high-performance component 10.

The clearance between end portion 26 of rotating component 24 (for example, a blade tip) and surface 21 may determine the flow boundary thickness, which may affect the efficiency and performance of high-performance component 10. In some examples, the flow boundary may be reduced or substantially minimized by causing contact between portion 26 of rotating component 24 and abradable surface 21 during predetermined operating conditions of high-performance component 10. To allow for continued operation during such contact, portion 26 may abrade abradable surface 21 of abradable track 20, such that rotating component 24 can continue to rotate while portion 26 contacts abradable track 20. For example, in examples in which rotating component 24 includes a blade, a blade tip may contact and cut a groove or path into abradable track 20 by abrading successive layers or portions of abradable surface 21 during operation of high-performance component 10. Thus, in some such examples, rotating component 24 may scrape abradable surface 21 of abradable track 20 with portion 26 of rotating component 24.

While abradable surface 21 is shown as being substantially coplanar with major surface 16 in the example illustrated in FIG. 1A, in other examples, abradable track 20 may define abradable surface 21 offset from major surface 16. For example, abradable track 20 may occupy a partial depth of channel 14 such that abradable surface 21 is disposed in a plane between major surface 16 and base 22. In other examples, abradable track 20 may extend beyond channel 14 so that major surface 16 is disposed along a plane between abradable surface 21 and base 22. In some examples, a base portion of abradable track 20 may be disposed in channel 14, while abradable surface 21 opposing the base portion may at least partially laterally extend beyond channel 14 along major surface 16. The position, shape, and geometry of abradable surface 21 may also change during operation of high-performance component 10. For example, over a number of cycles of operation, rotating component 24 may cut a groove or another pattern into abradable track 20, redefining abradable surface 21 over successive operating cycles. The groove may or may not be visually perceptible.

Figure 1B:
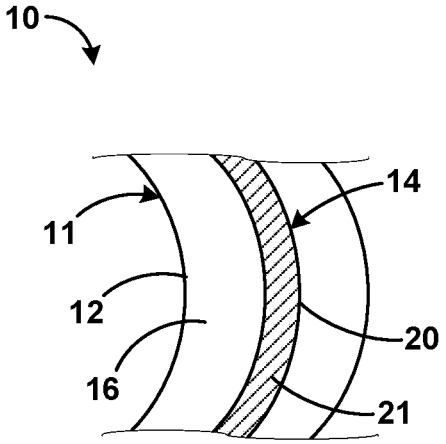
FIG. 1B is a conceptual and schematic partial plan view of the high-performance component of FIG. 1A.

FIG. 1B is a conceptual and schematic partial plan view of high-performance component 10 of FIG. 1A. In some examples, high-performance component 10 may include a substantially cylindrical shroud 11 including substrate 12. Abradable track 20 may run along a cylindrical path defined by cylindrical shroud 11, as shown in FIG. 1B. For example, abradable surface 21 of abradable track 20 in channel 14 may be substantially cylindrical and conform to a rotating path defined by portion 26 of rotating component 24. Thus, abradable track 20 may define a substantially cylindrical abradable surface 21.

Substrate 12 may define channel 14. In some examples, substrate 12 may include a metal or alloy substrate, for example, a Ni- or Co-based superalloy substrate, or a ceramic-based substrate, for example, a substrate including ceramic or ceramic matrix composite (CMC). Suitable ceramic materials, may include, for example, a silicon-containing ceramic, such as silica ($SiO_2$), silicon carbide (SiC); silicon nitride ($Si_3N_4$); alumina ($Al_2O_3$); an aluminosilicate; a transition metal carbide (e.g., WC, $Mo_2C$, TiC); a silicide (e.g., $MoSi_2$, $NbSi_2$, $TiSi_2$); combinations thereof; or the like. In some examples in which substrate 12 includes a ceramic, the ceramic may be substantially homogeneous.

In examples in which substrate 12 includes a CMC, substrate 12 may include a matrix material and a reinforcement material. The matrix material may include, for example, silicon metal or a ceramic material, such as silicon carbide (SiC), silicon nitride ($Si_3N_4$), an aluminosilicate, silica ($SiO_2$), a transition metal carbide or silicide (e.g., WC, $Mo_2C$, TiC, $MoSi_2$, $NbSi_2$, $TiSi_2$), or other ceramics described herein. The CMC may further include a continuous or discontinuous reinforcement material. For example, the reinforcement material may include discontinuous whiskers, platelets, fibers, or particulates. Additionally, or alternatively, the reinforcement material may include a continuous monofilament or multifilament two-dimensional or three-dimensional weave. In some examples, the reinforcement material may include carbon (C), silicon carbide (SiC), silicon nitride ($Si_3N_4$), an aluminosilicate, silica ($SiO_2$), a transition metal carbide or silicide (e.g. WC, $Mo_2C$, TiC, $MoSi_2$, $NbSi_2$, $TiSi_2$), another ceramic material described herein, or the like.

In some examples, the composition of the reinforcement material is the same as the composition of the matrix material. For example, a matrix material comprising silicon carbide may surround a reinforcement material including silicon carbide whiskers. In other examples, the reinforcement material includes a different composition than the composition of the matrix material, such as aluminosilicate fibers in an alumina matrix, or the like. One composition of substrate 12 that includes a CMC is a reinforcement material of silicon carbide continuous fibers embedded in a matrix material of silicon carbide. In some examples, substrate 12 includes a SiC—SiC CMC.

In some examples in which substrate 12 includes CMC, the CMC may include a plurality of plies 18, for example, plies 18 including plies of reinforcing fibers. Plurality of plies 18 may define channel 14, for example, by defining at least one of the leading and trailing ramps 15 and 17. In some examples, a series of successively shorter plies may be arranged in a radially inward direction to define leading and trailing ramps 15 and 17, while a series of relatively longer plies may define a base of channel 14 between ramps 15 and 17, in a radially outward direction with respect to the relatively shorter plies.

In some examples, substrate 12 may be provided with one or more coatings in addition to abradable track 20. In examples, in which substrate 12 is coated with one or more coatings, major surface 16 may be defined by the one or more coatings. For example, substrate 12 may be coated with an optional bond coat 32. Bond coat 32 may be deposited on or deposited directly on substrate 12 to promote adhesion between substrate 12 and one or more additional layers deposited on bond coat 32, including, for example, abradable track 20, or barrier coatings such as environmental or thermal barrier coatings. Bond coat 32 may promote the adhesion or retention of abradable track 20 within channel 14 or on substrate 12, or of additional coatings on substrate 12 or high-performance component 10.

The composition of bond coat 32 may be selected based on a number of considerations, including the chemical composition and phase constitution of substrate 12 and the layer overlying bond coat 32 (in FIG. 1A, abradable track 20). For example, when substrate 12 includes a superalloy with a γ-Ni γ'-Ni Al phase constitution, bond coat 32 may include a γ-Ni+γ'-NiAl phase constitution to better match the coefficient of thermal expansion of substrate 12. This may increase the mechanical stability (adhesion) of bond coat 32 to substrate 12. In examples in which substrate 12 includes a superalloy, bond coat 32 may include an alloy, such as an MCrAlY alloy (where M is Ni, Co, or NiCo), a β-NiAl nickel aluminide alloy (either unmodified or modified by Pt, Cr, Hf, Zr, Y, Si, and combinations thereof), a γ-Ni γ'-Ni Al nickel aluminide alloy (either unmodified or modified by Pt, Cr, Hf, Zr, Y, Si, and combination thereof), or the like. In some examples, bond coat 32 includes Pt.

In examples where substrate 12 includes a ceramic or CMC, bond coat 32 may include a ceramic or another material that is compatible with the substrate 12. For example, bond coat 32 may include mullite (aluminum silicate, $Al_6Si_2O_{13}$), silicon metal, silicon alloys, silica, a silicide, or the like. In some examples, bond coat 32 may include transition metal nitrides, carbides, or borides. Bond coat 32 may further include ceramics, other elements, or compounds, such as silicates of rare earth elements (i.e., a rare earth silicate) including Lu (lutetium), Yb (ytterbium), Tm (thulium), Er (erbium), Ho (holmium), Dy (dysprosium), Tb (terbium), Gd (gadolinium), Eu (europium), Sm (samarium), Pm (promethium), Nd (neodymium), Pr (praseodymium), Ce (cerium), La (lanthanum), Y (yttrium), or Sc (scandium). Some preferred compositions of bond layer 32 formed on a substrate 12 formed of a ceramic or CMC include silicon metal, mullite, an yttrium silicate or an ytterbium silicate.

Bond coat 32 may be applied by thermal spraying, including, plasma spraying, high velocity oxygen fuel (HVOF) spraying, low vapor plasma spraying; plasma vapor deposition (PVD), including electron-beam PVD (EB-PVD), direct vapor deposition (DVD), and cathodic arc deposition; chemical vapor deposition (CVD); slurry process deposition; sol-gel process deposition; electrophoretic deposition; or the like.

Substrate 12 may be coated with a barrier coating 34. Barrier coating 34 may include at least one of a thermal barrier coating (TBC) or an environmental barrier coating (EBC) to reduce surface temperatures and prevent migration or diffusion of molecular, atomic, or ionic species from or to substrate 12. The TBC or EBC may allow use of high-performance component 10 at relatively higher temperatures compared to high-performance component 10 without the TBC or EBC, which may improve efficiency of high-performance component 10.

Example EBCs include, but are not limited to, mullite; glass ceramics such as barium strontium alumina silicate (BaOx-SrO1-x-Al2$O_3$-2$SiO_2$; BSAS), barium alumina silicate (BaO—$Al_2O_3$-2$SiO_2$; BAS), calcium alumina silicate (CaO—$Al_2O_3$-2$SiO_2$), strontium alumina silicate (SrO—$Al_2O_3$-2$SiO_2$; SAS), lithium alumina silicate (Li2O—$Al_2O_3$-2$SiO_2$; LAS) and magnesium alumina silicate (2MgO-2$Al_2O_3$-5$SiO_2$; MAS); rare earth silicates, and the like. An example rare earth silicate for use in an environmental barrier coating is ytterbium silicate, such as ytterbium monosilicate or ytterbium disilicate. In some examples, an environmental barrier coating may be substantially dense, e.g., may include a porosity of less than about 5 vol. % to reduce migration of environmental species, such as oxygen or water vapor, to substrate 12.

Examples of TBCs, which may provide thermal insulation to the CMC substrate to lower the temperature experienced by the substrate, include, but are not limited to, insulative materials such as ceramic layers with zirconia or hafnia. In some examples, the TBC may include multiple layers. The TBC or a layer of the TBC may include a base oxide of either zirconia or hafnia and a first rare earth oxide of yttria. For example, the TBC or a layer of the TBC may consist essentially of zirconia and yttria. As used herein, to "consist essentially of" means to consist of the listed element(s) or compound(s), while allowing the inclusion of impurities present in small amounts such that the impurities do no substantially affect the properties of the listed element or compound.

In some examples, the TBC or a layer of the TBC may include a base oxide of zirconia or hafnia and at least one rare earth oxide, such as, for example, oxides of Lu, Yb, Tm, Er, Ho, Dy, Gd, Tb, Eu, Sm, Pm, Nd, Pr, Ce, La, Y, Sc. For example, a TBC or a TBC layer may include predominately (e.g., the main component or a majority) the base oxide zirconia or hafnia mixed with a minority amounts of the at least one rare earth oxide. In some examples, a TBC or a TBC layer may include the base oxide and a first rare earth oxide including ytterbia, a second rare earth oxide including samaria, and a third rare earth oxide including at least one of lutetia, scandia, ceria, neodymian, europia, and gadolinia. In some examples, the third rare earth oxide may include gadolinia such that the TBC or the TBC layer may include zirconia, ytterbia, samaria, and gadolinia. The TBC or the TBC layer may optionally include other elements or compounds to modify a desired characteristic of the coating, such as, for example, phase stability, thermal conductivity, or the like. Example additive elements or compounds include, for example, rare earth oxides. The inclusion of one or more rare earth oxides, such as ytterbia, gadolinia, and samaria, within a layer of predominately zirconia may help decrease the thermal conductivity of a TBC layer, e.g., compared to a TBC layer including zirconia and yttria. While not wishing to be bound by any specific theory, the inclusion of ytterbia, gadolinia, and samaria in a TBC layer may reduce thermal conductivity through one or more mechanisms, including phonon scattering due to point defects and grain boundaries in the zirconia crystal lattice due to the rare earth oxides, reduction of sintering, and porosity.

In some examples in which barrier coating 34 includes both the TBC and the EBC, either one of the TBC or the EBC may be disposed adjacent bond coat 32 or substrate 12, and the other one of the TBC or the EBC may be disposed opposed to and away from adjacent bond coat 32 or substrate 12. In some examples in which high-performance component 10 includes bond coat 32, and in which barrier coating 34 includes both the TBC and the EBC, the TBC may be between bond coat 32 and the EBC, or the EBC may be between bond coat 28 and the TBC. Barrier coating 34 (including one or more of the EBC, the TBC, or other layers) may be applied by thermal spraying, including, plasma spraying, high velocity oxygen fuel (HVOF) spraying, low vapor plasma spraying; plasma vapor deposition (PVD), including electron-beam PVD (EB-PVD), direct vapor deposition (DVD), and cathodic arc deposition; chemical vapor deposition (CVD); slurry process deposition; sol-gel process deposition; electrophoretic deposition; or the like. One or both of bond coat 32 and barrier coating 34 may be at least partially disposed or formed over one or both of major surface 16 or channel 14.

Channel 14 defined by substrate 12 may hold abradable track 20 in a predetermined orientation relative to rotating component 24. Channel 14 may also shield abradable track 20 from mechanical disturbances or agitation. For example, at least one of leading ramp 15 and trailing ramp 17 of channel 14 may help maintaining the integrity of abradable track 20, for example, by shielding abradable track 20 from one or more of chipping, disintegration, shattering, cracking, foreign object damage, or wear or erosion. The orientation and position of leading ramp 15, trailing ramp 17, and base 22 may thus affect the integrity of abradable track 20. In some examples, at least one of leading ramp 15 and trailing ramp 17 may be inclined at respective angles $\alpha$ and $\beta$ of at most 60°, or at most 45°, or at most 30°, relative to an average plane defined by major surface 16. The angles $\alpha$ and $\beta$ may be the same or different. The average plane defined by major surface 16 is a plane that is substantially parallel to major surface 16, and does not include minor surface variations or surface roughness.

In some examples, at least one of leading ramp 15 and trailing ramp 17 is inclined at an angle of at most 60° relative to a plane defined by major surface 16. Providing an angle of at most 60° may allow for more uniform application of abradable track 20 within channel 14, for example, when abradable track 20 is formed using techniques such as thermal spraying. For example, angles of at most 60° may allow for relatively uniform coating thickness and relatively uniform porosity of abradable track 20. Providing an angle of at most 60° may thus help in maintaining the integrity of abradable track 20 during predetermined operating conditions. In some examples, at least one of leading ramp 15 and trailing ramp 17 may be inclined at respective angles $\alpha$ and $\beta$ of at least 5°, or at least 15°, or at least 30°, or at least 45°, while being at most 60°. For example, at least one of leading ramp 15 and trailing ramp 17 may be inclined at respective angles $\alpha$ and $\beta$ between 5° and 60°, inclusive, or between 15° and 60°, inclusive, or between 45° and 60°, inclusive, or between, between 5° and 30°, inclusive, or between 15° and 30°, inclusive, or between 5° and 45°, inclusive, or between 15° and 45°, inclusive. For example, providing an angle of at least 5°, or at least 15°, or at least 30°, or at least 45°, may assist with maintaining abradable track 20 between leading ramp 15 and trailing ramp 17 during operation, and may assist with maintaining the integrity of abradable track 20.

Leading ramp 15 and trailing ramp 17 of abradable track 20 may be substantially planar, as shown in the example illustrated in FIG. 1A. For example, leading ramp 15, trailing ramp 17, and base 22 may define a polygonal cross-section of channel 14. In some examples, one or more of leading ramp 15, trailing ramp 17, or base 22, may define a curved surface. For example, instead of contacting base 22 of channel 14 at an angle, at least one of leading ramp 15 or trailing ramp 17 may smoothly graduate into base 22 of channel 14. The respective curved surfaces of leading ramp 15 or trailing ramp 17 may respectively define angles $\alpha$ and $\beta$ with respect to major surface 16. In some examples in which at least one of leading ramp 15 and trailing ramp 17 define curved surfaces, channel 14 may exhibit an at least partly curved cross-section, for example, a cross-section including one or more curved or flat sections.

In some examples, one or more of leading ramp 15, trailing ramp 17, or base 22 may respectively define substantially smooth surfaces. Substantially smooth surfaces according to the disclosure may include surfaces that exhibit a contour deviation within a predetermined constraint. For example, the contour deviation may be within ±1 inch (25.4 mm) height per inch (25.4 mm) length in any direction along the surface, or within ±0.1 inch (2.54 mm) height per inch (2.54 mm) length, or ± within 0.01 inch (0.254 mm) height per inch (2.54) length. In some examples, at least one of leading ramp 15, trailing ramp 17, or base 22 may define three-dimensional surface features, such as pits, grooves, depressions, stripes, columns, protrusions, ridges, or the like, or combinations thereof. In some such examples, the surface features may increase mechanical adhesion between abradable track 20 and channel 14. While a single channel 14 is shown in the example of FIG. 1A, in some examples, substrate 12 may define a plurality of channels including channel 14. The plurality of channels may include channels running substantially parallel to each other, and a base portion of abradable track 20 may be disposed in the plurality of channels, with abradable surface 21 opposing the base portion.

Abradable track 20 may have any suitable width along abradable surface 21. For example, the width of abradable track 20 may be relatively larger than a width of end portion 26 of rotating component 24 contacting abradable track 20. In some examples, the width of abradable track 20 is at least 5%, or at least 10%, or at least 20%, greater than the width of end portion 26 of rotating component 24. The width of abradable track 20 may be less than a predetermined threshold. For example, the width of abradable track 20 may be less than 150%, or less than 120%, or less than 110%, of the width of end portion 26 of rotating component 24. Providing the width less than the predetermined threshold may help maintain the integrity of abradable track 20 by reducing the extent of abradable track 20 exposed to relatively harsh operating conditions of high-performance component 10.

While one rotating component 24 is shown in the example illustrated in FIG. 1A, a plurality of rotating components may include rotating component 24, and one or more of rotating components of the plurality of rotating components may contact and abrade abradable track 20, for example, in series or in succession. While high-performance component 10 may include rotating component 24, in some examples, high-performance component 10 may include, instead of, or in addition to rotating component 24, at least one moving or vibrating component defining an end portion adjacent to abradable track 20. Thus, in some such examples, an end portion of at least one moving or vibrating component may contact and abrade abradable track 20.

Thus, in some examples, an example gas turbine system may include high-performance component 10 according to the disclosure, and further include rotating component 24 configured to contact, cut, scrape, or abrade surface 21 of abradable track 20 with end portion 26 of rotating component 24 during predetermined operating conditions of high-performance component 10. In examples in which high-performance component 10 includes an aeronautical gas turbine engine, the predetermined operating conditions may include a cruising condition. For example, shortly after starting up the engine, the engine may be relatively colder than the typical operating temperatures of the engine. During the start-up period, a relatively higher clearance may be maintained between end portions of rotating components of the engine, for example, end portion 26 of rotating component 24 and abradable track 20, to reduce the torque requirements. As the temperature of the engine rises to operating temperatures, the increased temperatures may cause thermal expansion in the blade, causing end portion 26 to contact abradable track 20. Thus, the clearance may be reduced during typical operating conditions of the engine.

Abradable track 20 may include any suitable abradable composition capable of being abraded by rotating component 24. For example, the abradable composition may exhibit a hardness that is relatively lower than a hardness of portion 26 of rotating component 24 such that portion 26 can abrade porous abradable composition 24 by contact. Thus, the hardness of abradable track 20 relative to the hardness of portion 26 may be indicative of the abradability of abradable track 20. While the abradability of abradable track 20 may depend on the composition of abradable track 20, for example, the physical and mechanical properties of the composition, the abradability of abradable track 20 may also depend on a porosity of abradable track 20. For example, a porous composition may exhibit a higher abradability compared to a nonporous composition, and a composition with a relatively higher porosity may exhibit a higher abradability compared to a composition with a relatively lower porosity, everything else remaining the same.

Thus, in some examples, abradable track 20 may include a porous abradable composition 28. For example, porous abradable composition 28 may include a matrix composition and a plurality of pores (not shown). The matrix composition of porous abradable composition 28 may include at least one of aluminum nitride, aluminum diboride, boron carbide, aluminum oxide, mullite, zirconium oxide, carbon, silicon carbide, silicon nitride, silicon metal, silicon alloy, a transition metal nitride, a transition metal boride, a rare earth oxide, a rare earth silicate, zirconium oxide, a stabilized zirconium oxide (for example, yttria-stabilized zirconia), a stabilized hafnium oxide (for example, yttria-stabilized hafnia), or barium-strontium-aluminum silicate, or mixtures and combinations thereof. In some embodiments, the abradable coating includes at least one silicate, which may refer to a synthetic or naturally-occurring compound including silicon and oxygen. Suitable silicates include, but are not limited to, rare earth disilicates, rare earth monosilicates, barium strontium aluminum silicate, and mixtures and combinations thereof.

In some examples, porous abradable composition 28 may include a base oxide of zirconia or hafnia and at least one rare earth oxide, such as, for example, oxides of Lu, Yb, Tm, Er, Ho, Dy, Gd, Tb, Eu, Sm, Pm, Nd, Pr, Ce, La, Y, Sc. For example, porous abradable composition 28 may include predominately (e.g., the main component or a majority) the base oxide zirconia or hafnia mixed with a minority amounts of the at least one rare earth oxide. In some examples, porous abradable composition 28 may include the base oxide and a first rare earth oxide including ytterbia, a second rare earth oxide including samaria, and a third rare earth oxide including at least one of lutetia, scandia, ceria, neodymian, europia, and gadolinia. In some examples, the third rare earth oxide may include gadolinia such that porous abradable composition 28 may include zirconia, ytterbia, samaria, and gadolinia. The porous abradable composition 28 may optionally include other elements or compounds to modify a desired characteristic of the coating, such as, for example, phase stability, thermal conductivity, or the like. Example additive elements or compounds include, for example, rare earth oxides. The inclusion of one or more rare earth oxides, such as ytterbia, gadolinia, and samaria, within a layer of predominately zirconia may help decrease the thermal conductivity of porous abradable composition 28, e.g., compared to a composition including zirconia and yttria. While not wishing to be bound by any specific theory, the inclusion of ytterbia, gadolinia, and samaria in porous abradable composition 28 may reduce thermal conductivity through one or more mechanisms, including phonon scattering due to point defects and grain boundaries in the zirconia crystal lattice due to the rare earth oxides, reduction of sintering, and porosity The plurality of pores may include at least one of interconnected voids, unconnected voids, partly connected voids, spheroidal voids, ellipsoidal voids, irregular voids, or voids having any predetermined geometry, and networks thereof. In some examples, adjacent faces or surfaces of agglomerated, sintered, or packed particles or grains in porous abradable composition 28 may define the plurality of pores. Porous abradable composition 28 may exhibit any suitable predetermined porosity to provide a predetermined abradability to abradable surface 21 of abradable track 20. In some examples, porous abradable composition 28 exhibits a porosity between about 5 vol. % and about 95 vol. %, or between about 10 vol. % and about 50 vol. %, or between about 10 vol. % and about 40 vol. %, or between about 15 vol. % and 35 vol. %, or about 25 vol. %. Without being bound by theory, a porosity lower than 10 vol. % may substantially reduce the abradability below specifications and may result in damage to the component, while a porosity higher than 40 vol. % may substantially increase the fragility and erodibility, reduce the integrity of abradable track 20, and can lead to spallation of portions of abradable track 20 instead of controlled abrasion of abradable track 20.

Porous abradable composition 28 may be formed by any suitable technique, for example, example techniques including thermal spraying according to the disclosure. Thus, in some examples, porous abradable composition 28 may include a thermal sprayed composition. The thermal sprayed composition may define pores formed as a result of thermal spraying, for example, resulting from agglomeration, sintering, or packing of grains or particles during the thermal spraying.

In some examples, the thermal sprayed composition may include an additive configured to define pores in response to thermal treatment dispersed in the matrix composition. The additive may be disintegrated, dissipated, charred, or burned off by heat exposure during the thermal spraying, or during a post-formation heat treatment, or during operation of high-performance component 10, leaving voids in the matrix composition defining the plurality of pores. The post-deposition heat-treatment may be performed at up to about 1150° C. for a component having a substrate 12 that includes a superalloy, or at up to about 1500° C. for a component having a substrate 12 that includes a CMC or other ceramic. For example, the additive may include at least one of graphite, hexagonal boron nitride, or a polymer. In some examples, the polymer may include a polyester. The shapes of the grains or particles of the additive may determine the shape of the pores. For example, the additive may include particles having spheroidal, ellipsoidal, cuboidal, or other predetermined geometry, or flakes, rods, grains, or any other predetermined shapes or combinations thereof, and may be thermally sacrificed by heating to leave voids having respective complementary shapes.

The concentration of the additive may be controlled to cause the porous abradable composition to exhibit a predetermined porosity, for example, a porosity between about 10% and about 40%. For example, a higher concentration of the additive may result in a higher porosity, while a lower concentration of the additive may result in a lower porosity. Thus, for a predetermined matrix composition, the porosity of porous abradable composition 28 may be changed to impart a predetermined abradability to abradable track 20.

The porosity may also be controlled by using additives or processing techniques to provide a predetermined porosity.

Abradable track 20, bond coat 32, or barrier coating 34 may be formed using any suitable systems and techniques. For example, respective coating compositions may be sprayed or deposited under predetermined conditions of temperature, pressure, flow rate, duration, composition, and relative concentrations, as described with reference to the example system of FIG. 2 and the example technique of FIG. 3.

Figure 2:
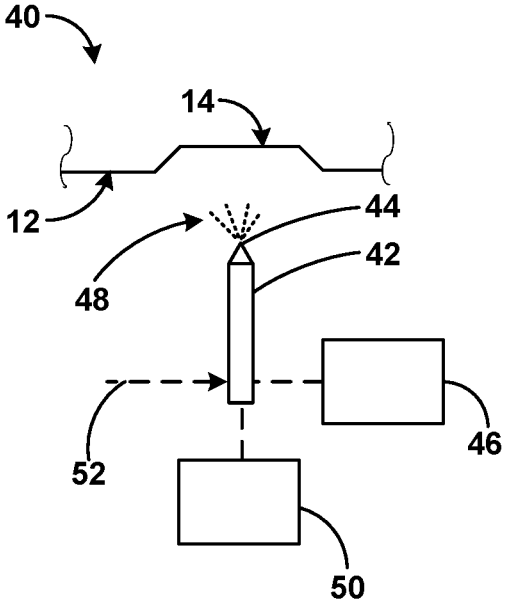
FIG. 2 is a conceptual and schematic block diagram illustrating an example system for forming an abradable track on a high-performance component.

FIG. 2 is a conceptual and schematic block diagram illustrating an example system 40 for forming abradable track 20 on high-performance component 10. While example system 40 described with reference to FIG. 2 may be used to prepare example articles described with reference to FIGS. 1A and 1B, example system 40 may be used to prepare any example articles according to the disclosure.

System 40 includes a spray gun 42 having a nozzle 44 coupled to a reservoir 46. Reservoir 46 holds a spray composition sprayed as a spray 48 through nozzle 44. System 40 may further include a stream 50 including a working fluid or a gas, for example, a fluid or gas ignitable or energizable to form a plasma, or a fluid including a fuel ignitable to form a high velocity oxygen fuel stream. System 40 may include an igniter (not shown) to ignite the plasma or fuel stream. System 40 may include a platform, an articulating or telescoping mount, a robotic arm, or the like to hold, orient, and move spray gun 42 or substrate 12. Spray gun 42 may be held, oriented, moved, or operated manually by an operator, or semi-automatically or automatically with the assistance of a controller.

For example, system 40 may include a controller 52 to control the operation of spray gun 42. Controller 52 may include control circuitry to control one or more of the flow rate of the spray composition or of stream 50, the pressure, temperature, nozzle aperture, spray diameter, or the relative orientation, position, or distance of nozzle 44 with respect to substrate 12. The control circuitry may receive control signals from a processor or from an operator console. In some examples, system 40 may include a booth or a chamber (not shown) at least partly surrounding spray gun 44 and substrate 12 to shield the environment from spray 48 and from the operating conditions of the spraying. In some such examples, one or both of reservoir 46 or controller 50 may be outside the booth or chamber. System 40 may be used to form abradable track 20 on substrate 12 according to an example technique described with reference to FIG. 3.

Figure 3:
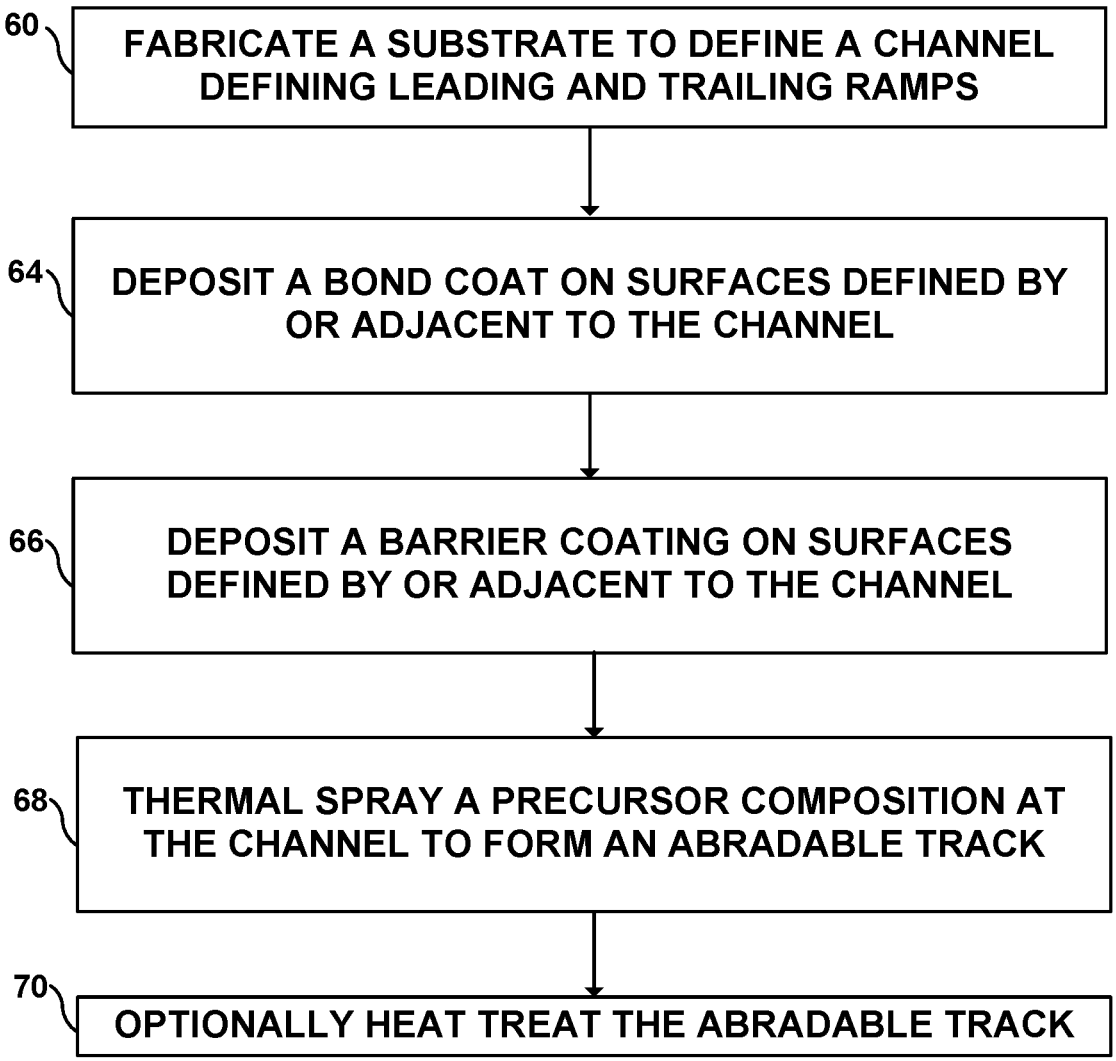
FIG. 3 is a flow diagram illustrating an example technique for forming an abradable track on a high-performance component.

FIG. 3 is a flow diagram illustrating an example technique for forming abradable track 20 on high-performance component 10. The technique of FIG. 3 will be described with respect to high-performance component 10 of FIGS. 1A and 1B, and system 40 of FIG. 2. However, the technique of FIG. 3 may be used to form other articles, and high-performance component 10 of FIGS. 1A and 1B may be formed using other techniques and systems.

In some examples, the technique of FIG. 3 may be performed on a pre-machined substrate, for example substrate 12 pre-machined or otherwise fabricated to define channel 14. In some other examples, the technique of FIG. 3 may include forming channel 14 in substrate 12. For example, the technique may include fabricating substrate 12 to define at least a portion of channel 14 (60). The fabricating (60) may include machining, milling, drilling, stamping, molding, depositing, additive manufacturing or any other suitable technique to form substrate 12, remove material from substrate 12, or add material to substrate 12 to define channel 14. The fabricating (60) may cause substrate 12 to at least partially define one or more of base 22, leading ramp 15, or trailing ramp 17, for example, by exposing surfaces by removing a bulk of substrate 12 or adding material defining surfaces to substrate 12.

In examples in which substrate 12 includes a ceramic matrix composite, the fabricating (60) may optionally include laying a plurality of plies 30 of the ceramic matrix composite. For example, the plurality of plies 30 may at least partially defines respective leading and trailing ramps 15 and 17 of channel 14. In some such examples, plies 30 of varying lengths may successively be laid on substrate 12 in a direction away from base 22 of channel 14 and toward major surface 16 to define channel 14 with a predetermined geometry. In other such examples, one or more stacks or sections of plies 30 may be pre-assembled and applied to substrate 12. In some such examples, plies 30 may include woven or non-woven ceramic fabric or fibers pre-impregnated with a ceramic matrix slurry or composition. In other such examples, non-impregnated fibers or fabric may be assembled as plies 30, and plies 30 on substrate 12 may be impregnated with the ceramic matrix slurry or composition. After laying plies 30 on substrate 12, plies 30 may be treated, for example, using one or more of heat, pressure, vacuum, to set or cure plies 30 and the ceramic matrix slurry or composition to form substrate 12 including set plies 30 defining channel 14. In some examples, substrate 12 may be machined before, after, or both before and after laying plies 30. For example, the machining may be performed before laying plies 30 to smoothen or clean a surface of substrate 12, or to partly define channel 14, or to provide cavities, protrusions, grooves, or other geometric features to promote the seating of plies 30 on substrate 12. The machining may be performed after laying plies 30 to smoothen of clean a surface defined by plies 30 or by channel 14, or to provide cavities, protrusions, grooves, or other geometric features to promote the adhesion of abradable track 20 to channel 14 of substrate 12

The example technique of FIG. 3 may optionally include at least one of: depositing, before thermally spraying (68), bond coat 32 on surfaces defined by or adjacent to channel 14 (64); or depositing, before thermally spraying (68), barrier coating 34 on surfaces defined by or adjacent to channel 14 (66). One or both of depositing of bond coat 32 (64) or depositing of barrier coating 34 (66) may include at least one of thermal spraying, plasma spraying, physical vapor deposition, chemical vapor deposition, or any other suitable technique.

The example technique of FIG. 3 includes thermal spraying a precursor composition at channel 14 defined by substrate 12 of high-performance component 10 to form abradable track 20 occupying channel 14 (68). Thermal spraying (68) may include any spraying technique suitable for spraying the precursor composition to form coatings including metals, alloys, or ceramics, for example, plasma spraying, high velocity oxygen fuel (HVOF) spraying, or wire arc spraying. Thermal spraying (68) may include introducing the precursor composition into an energized flow stream (for example, an ignited plasma stream) to result in at least partial fusion or melting of the precursor composition, and directing or propelling the precursor composition toward substrate 12, for example, at channel 14. The propelled precursor composition impacts substrate 12 to form a portion of a coating, for example, of abradable track 20.

The precursor composition may include a matrix composition described elsewhere in the disclosure. In some examples, the precursor composition may be suspended or dispersed in a carrier medium, for example, a liquid or a gas.

The precursor composition may also include an additive (described elsewhere in the disclosure) configured to define pores in response to thermal treatment. In some examples, the additive may be sacrificially removed in response to heat subjected by thermal spraying (68), or by a separate heat treatment. For example, the technique of FIG. 3 may optionally include heat treating abradable track 20 (70). The heat treating (70) may result in removal or disintegration of the additive to leave pores forming porous abradable composition 24. In some examples, heat treating (70) may, instead of, or in addition to, removing the additive, also change the physical, chemical, mechanical, material, or metallurgical properties of abradable composition 24. For example, heat treating (70) may anneal porous abradable composition formed by the thermal spraying, resulting in an increase in strength or integrity of abradable track 20 compared to un-annealed abradable track 20. In some examples, the precursor composition may not include an additive, and the parameters of thermal spraying (68) may be controlled to cause grains or particles in the precursor composition to agglomerate, compact, or sinter on contact of spray 44 with substrate 12 to define pores between surfaces of the grains or particles. For example, the concentration of the additive or the parameters of the thermal spraying (68) may be controlled to cause porous abradable composition 24 to exhibit a porosity between about 10% and about 40%. Thus, the example technique of FIG. 3 may be used to form abradable track 20 in channel 14 of substrate 12.

Various examples have been described. These and other examples are within the scope of the following claims.

The invention claimed is:

1. A high-performance component comprising:

a substrate defining a channel, wherein the channel defines a leading ramp and a trailing ramp; and an abradable track between the respective leading and the trailing ramps, wherein the abradable track comprises a porous abradable composition, wherein the high-performance component defines a major surface adjacent the channel, wherein at least one of the leading ramp and the trailing ramp is inclined at an angle of at least 15° relative to a plane defined by the major surface, and wherein the at least one of the leading ramp and the trailing ramp is inclined at an angle of at most 60° relative to the plane defined by the major surface.

2. The high-performance component of claim 1, wherein the porous abradable composition exhibits a porosity between 10 vol. % and 40 vol. %.

3. The high-performance component of claim 1, wherein the substrate comprises a ceramic matrix composite.

4. The high-performance component of claim 3, wherein the ceramic matrix composite comprises a plurality of plies defining the respective leading and trailing ramps.

5. The high-performance component of claim 1, wherein the porous abradable composition comprises at least one of aluminum nitride, aluminum diboride, boron carbide, aluminum oxide, mullite, zirconium oxide, carbon, silicon metal, silicon alloy, silicon carbide, silicon nitride, a transition metal nitride, a transition metal boride, a rare earth oxide, a rare earth silicate, a stabilized zirconium oxide, a stabilized hafnium oxide, or barium-strontium-aluminum silicate.

6. The high-performance component of claim 1, wherein the porous abradable composition comprises a thermal sprayed composition.

7. The high-performance component of claim 1, wherein the high-performance component comprises a substantially cylindrical shroud, and wherein the abradable track runs along a cylindrical path defined by the cylindrical shroud.

8. The high-performance component of claim 7, wherein the abradable track defines a substantially cylindrical abradable surface.

9. A high-performance system comprising the high-performance component of claim 1, the high-performance system further comprising a rotating component configured to contact an abradable surface of the abradable track with a portion of the rotating component.

10. The high-performance component of claim 1, wherein at least one of the trailing ramp or the leading ramp is defined by a substantially planar surface.

11. A method for forming an abradable track on a high-performance component, the method comprising:

thermal spraying a precursor composition at a channel defined by a substrate of the high-performance component to form the abradable track between leading and trailing ramps defined by the channel, wherein the abradable track comprises a porous abradable composition, wherein the high-performance component defines a major surface adjacent the channel, wherein at least one of the leading ramp and the trailing ramp is inclined at an angle of at least 15° relative to a plane defined by the major surface, and wherein the at least one of the leading and the trailing ramps are inclined at an angle of at most 60° relative to the plane defined by the major surface.

12. The method of claim 11, wherein the precursor composition comprises an additive configured to define pores in response to thermal treatment, a matrix composition, and a carrier medium.

13. The method of claim 12, wherein the matrix composition comprises at least one of aluminum nitride, aluminum diboride, boron carbide, aluminum oxide, mullite, zirconium oxide, carbon, silicon metal, silicon alloy, silicon carbide, silicon nitride, a transition metal nitride, a transition metal boride, a rare earth oxide, a rare earth silicate, a stabilized zirconium oxide, or barium-strontium-aluminum silicate.

14. The method of claim 12, wherein the additive comprises at least one of graphite, hexagonal boron nitride, a polymer, or a polyester.

15. The high-performance component of claim 12, wherein a concentration of the additive is controlled to cause the porous abradable composition to exhibit a porosity between 10 vol. % and 40 vol. %.

16. The method of claim 11, further comprising fabricating the substrate to define at least a portion of the channel.

17. The method of claim 16, wherein the fabricating comprises laying a plurality of plies of a ceramic matrix composite, wherein the plurality of plies defines the leading and trailing ramps of the channel.

18. The method of claim 11, further comprising at least one of:

depositing, before the thermally spraying, a bond coat on surfaces defined by or adjacent to the channel; or depositing, before the thermally spraying, a barrier coating on surfaces defined by or adjacent to the channel.

* * * * *